US009771635B2

(12) United States Patent
Wang et al.

(10) Patent No.: US 9,771,635 B2
(45) Date of Patent: Sep. 26, 2017

(54) CAST ALUMINUM ALLOY FOR STRUCTURAL COMPONENTS

(75) Inventors: Qigui Wang, Rochester Hills, MI (US); Hengcheng Liao, Nanjing (CN)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 994 days.

(21) Appl. No.: 13/545,345

(22) Filed: Jul. 10, 2012

(65) Prior Publication Data

US 2014/0017115 A1 Jan. 16, 2014

(51) Int. Cl.

| | |
|---|---|
| ***C22C 21/02*** | (2006.01) |
| ***C22C 21/04*** | (2006.01) |
| ***B22D 21/00*** | (2006.01) |

(52) U.S. Cl.

CPC ..... *C22C 21/02* (2013.01); *B22D 21/007* (2013.01); *C22C 21/04* (2013.01)

(58) Field of Classification Search

CPC ..... C22C 21/02; C22C 21/04

See application file for complete search history.

(56) References Cited

U.S. PATENT DOCUMENTS

| | | | | |
|---|---|---|---|---|
| 5,055,256 | A | 10/1991 | Sigworth et al. | |
| 6,921,512 | B2 | 7/2005 | Doty | |
| 2005/0109429 | A1* | 5/2005 | Okamoto | C22F 1/043 148/440 |
| 2005/0199318 | A1 | 9/2005 | Doty | |
| 2008/0031768 | A1 | 2/2008 | Valtierra-Gallardo et al. | |

FOREIGN PATENT DOCUMENTS

| | | | |
|---|---|---|---|
| CN | 1847429 | A * | 10/2006 |

* cited by examiner

*Primary Examiner* — Roy King
*Assistant Examiner* — Janelle Morillo

(57) ABSTRACT

An aluminum alloy that can be cast into structural components wherein the alloy has reduced casting porosity, improved combination of mechanical properties including tensile strength, fatigue, ductility in the cast condition and in the heat treated condition.

20 Claims, 2 Drawing Sheets

CAST ALUMINUM ALLOY FOR STRUCTURAL COMPONENTS

BACKGROUND OF THE INVENTION

This invention relates generally to aluminum alloys that can be cast into structural components; non-limiting examples of which include engine blocks, cylinder heads, suspension parts such as shock towers and control arms, wheels, and airplane doors.

Al—Si based cast aluminum alloys, such as the 300 series aluminum alloys, have widespread applications for structural components in the automotive, aerospace, and general engineering industries because of their good castability, corrosion resistance, machinability, and, particularly, high strength-to-weight ratio in the heat-treated condition. In terms of castability, low silicon concentrations have been thought to inherently produce poor castability because of the increased freezing range and the reduced latent heat. With high Si content (>14%), however, the coarse primary Si particles will significantly reduce machinability, ductility and fracture toughness of the materials.

In Al—Si casting alloys (e.g. alloys 319, 356, 390, 360, 380), strengthening is achieved through heat treatment after casting with addition of various alloying elements including, but not limited to Cu and Mg. The heat treatment of cast aluminum involves at least a mechanism described as age hardening or precipitation strengthening that involves, but is not limited to, three steps including (1) solution treatment at a relatively high temperature below the melting point of the alloy (also defined as T4), often for times exceeding 8 hours or more to dissolve its alloying (solute) elements and homogenize or modify the microstructure; (2) rapid cooling, or quenching into cold or warm liquid media such as water, to retain the solute elements in a supersaturated solid solution (SSS); and (3) artificial aging (T5) by holding the alloy for a period of time at an intermediate temperature suitable for achieving hardening or strengthening through precipitation. Solution treatment (T4) serves three main purposes: (1) dissolution of elements that will later cause age hardening, (2) spherodization of undissolved constituents, and (3) homogenization of solute concentrations in the material. Quenching after T4 solution treatment is to retain the solute elements in a supersaturated solid solution and also to create a supersaturation of vacancies that enhance the diffusion and the dispersion of precipitates. To maximize strength of the alloy, the precipitation of all strengthening phases should be prevented during quenching. Aging (T5, either natural or artificial aging) creates a controlled dispersion of strengthening precipitates.

The most common Al—Si based alloy used in making automotive engine blocks and cylinder heads is heat treatable cast aluminum alloy 319 (nominal composition by weight: 6.5% Si, 0.5% Fe, 0.3% Mn, 3.5% Cu, 0.4% Mg, 1.0% Zn, 0.15% Ti and balance Al) and A356 (nominal composition by weight: 7.0% Si, 0.1% Fe, 0.01% Mn, 0.05% Cu, 0.3% Mg, 0.05% Zn, 0.15% Ti, and balance Al). Because of the relatively low Si content (6~7 wt %) in both alloys, the liquidus temperatures are high (~615 C for A356 and ~608 C for 319) leading to a high melting energy usage and high solubility of hydrogen. The high freezing range of both A356 (greater than or equal to 60 C) and 319 (greater than or equal to 90 C) also increases the mushy zone size and shrinkage tendency. Importantly, both alloys present dual microstructures of primary dendritic aluminum grains and eutectic (Al+Si) grains. During solidification, the eutectic grains solidify between the pre-solidified dendritic Al networks which makes feeding eutectic shrinkage difficult. In Al-7% Si alloys, the volume fraction of eutectic grains is about 50%. In addition, the engine blocks and particularly cylinder heads made of such aluminum alloys may experience thermal mechanical fatigue (TMF) over time in service, especially in high performance engine applications.

The addition of strengthening elements such as Cu, Mg, and Mn can have a significant effect on the physical properties of the materials, including specific undesirable effects. For example, it has been reported that aluminum alloys with high content of copper (3-4%) have experienced an unacceptable rate of corrosion especially in salt-containing environments. Typical high pressure die casting (HPDC) aluminum alloys, such as A 380 or 383 used for transmission and engine parts contain 2-4% copper. It can be anticipated that the corrosion issue of these alloys will become more significant particularly when longer warranty time and higher vehicle mileages are required.

Although there is a commercial alloy 360 (nominal composition by weight: 9.5% Si, 1.3% Fe, 0.3% Mn, 0.5% Cu, 0.5% Mg, 0.5% Ni, 0.5% Zn, 0.15% Sn and balance Al) designated for corrosion resistance applications, such alloy may experience thermal mechanical fatigue problems over time in service, especially in the high performance engine applications.

There is a need to provide improved castable aluminum alloys that are suitable for both sand and metal mold casting and can produce castings with reduced casting porosity and improved alloy strength, fatigue, and corrosion resistance, particularly for applications at elevated temperatures.

SUMMARY OF THE INVENTION

According to an aspect of the various embodiments, an aluminum alloy is herein described consisting essentially of, by weight percentage, from 11% to 13.5% Silicon, up to 0.5% Copper, from 0.4 to 0.55% Magnesium, up to 0.3% Iron, up to 0.3% Manganese, up to 0.1% Titanium, up to 0.4% Zinc, from about 0.015% to 0.08% Strontium, from 0.03% to 0.05% Boron, and the balance aluminum.

According to an aspect of the various embodiments, a method of casting an automotive component from an aluminum alloy is herein such that thermal fatigue is reduced comprising: providing a mold; and introducing an aluminum alloy melt into the mold wherein the aluminum alloy consists essentially of, by weight percentage, from 11% to 13.5% Silicon, up to 0.5% Copper, from 0.4 to 0.55% Magnesium, up to 0.3% Iron, up to 0.3% Manganese, up to 0.1% Titanium, up to 0.4% Zinc, from about 0.015% to 0.08% Strontium, from 0.03% to 0.05% Boron, and the balance aluminum, and wherein the thermal fatigue of the automotive casting is reduced.

BRIEF DESCRIPTION OF THE DRAWINGS

The following detailed description of specific embodiments can best be understood when read in conjunction with the following drawings, where like structure is indicated with like reference numerals in which.

DETAILED DESCRIPTION

Embodiments herein described provide improved castable aluminum alloys that are suitable for both sand and metal mold casting and can produce castings with reduced casting porosity and improved alloy strength, fatigue and corrosion resistance particularly for applications at elevated temperatures.

Figure 1:
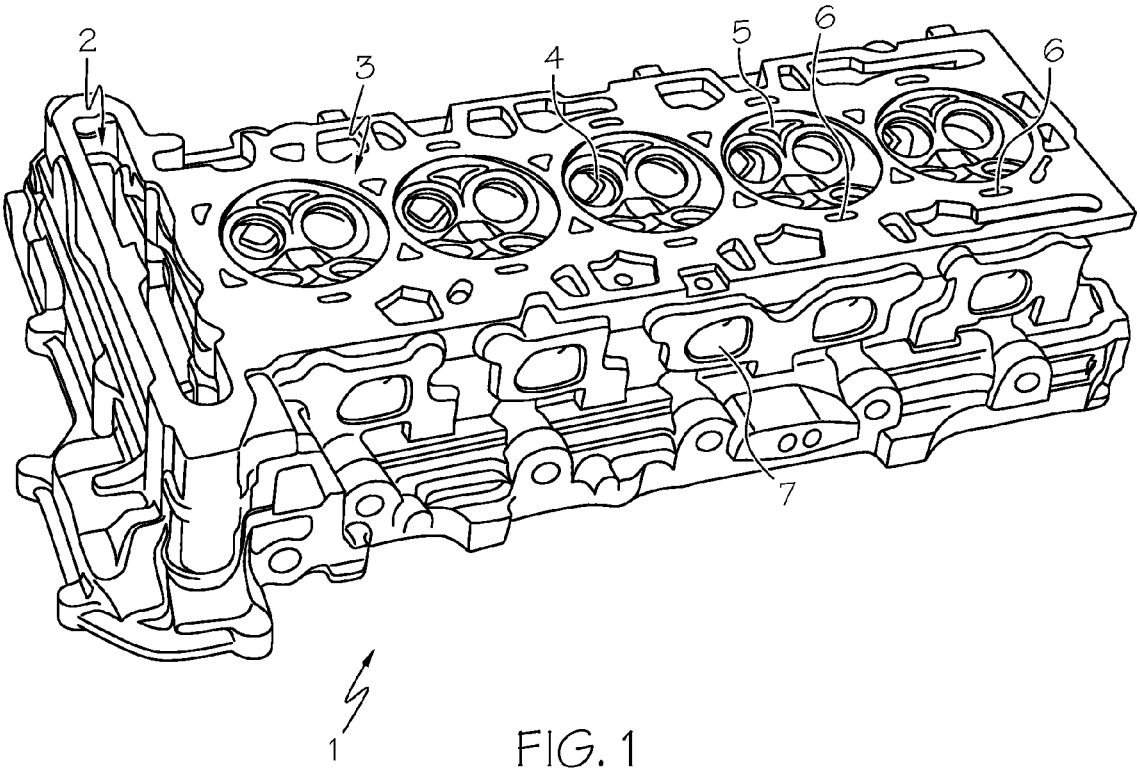
FIG. 1 illustrates a cast cylinder head showing the complexity of the casting geometry.

Referring first to FIG. 1, a cylinder head 1 is illustrated. Cylinder head 1 aspects include (in addition to the cylinders) a chain guard 2, deck face (that contacts the gasket and is assembled to engine block) 3, and exhaust port 4. Also shown in FIG. 1 are: the combustion dome 5, water jacket passage 6, and intake passage 7. Various embodiments of cylinder heads are herein contemplated, such as automotive cylinder heads.

Photomicrographs have been examined (not shown) that indicate that the microstructure of specific embodiments described herein shows an alloy containing fine eutectic dendrite grains while analysis of the microstructure of the prior art shows the presence of large eutectic silicon particles and coarse aluminum dendrites. The microstructure of specific embodiments described herein show fine eutectic silicon fibers as well as eutectic aluminum dendrites. In cast aluminum alloys, the microstructure fineness is affected by the cooling rate when the casting is solidified from the liquid. For the same cooling conditions, specific embodiments of the proposal alloy produce much finer eutectic silicon particles through the addition of strontium and particularly boron for eutectic grain refinement, in comparison with the prior art. Finer grains offer benefits of improved mechanical properties such as higher tensile strength, increased ductility and fatigue resistance.

The eutectic silicon fibers of specific embodiments herein described are very fine, being less than one micrometer. In contrast, an analysis of the microstructure of prior art shows that it contains large eutectic silicon particles (greater than ten micrometers). An analysis of the microstructure of the as-cast Al-12.6% Si, 0.3% Mg, 0.25% Cu, 0.18% Fe, 0.045% Sr, and 0.026% B alloy shows the fineness of eutectic silicon fibers. The size of the eutectic Si fibers is less than 1 um (micrometer).

Typically, the microstructure constituents are quantified using quantitative metallurgy. The quantitative metallurgy is usually done in an image analyzer with metallurgically polished samples. All samples for the quantitative metallographic analysis were prepared using standard techniques. Following a 1 um diamond finish, the final polish was achieved using a commercial SiO2 slurry (Struers OP-U). For specific purposes of examination, the polished samples were further subjected to additional preparation. The silicon particles were usually quantified on fully heat-treated samples in terms of their mean aspect ratio, area equivalent circle diameter, shape factor (roundness, $SF=P^2/4\pi A$, where P is particle perimeter and A the particle area), length, and area fraction on the polished section. About 100 fields of 5,000-10,000 particles were measured for each sample. As the automated measurement of particle features depends somewhat on the grey level setting on the instrument, the detection level was set at about 60% of the aluminum grey level.

An analysis has been performed of macrographs (not shown) of eutectic grains as they appear, varying with changes in magnesium levels for specific embodiments described herein. The analysis included alloys also containing (in addition to varying amounts of magnesium) 13% Silicon as well as 0.02% Strontium. Specifically analyzed were different additions of magnesium under steady state solidification with a temperature gradient of about 2.1° C./mm and a growth velocity of 0.1 mm/s. For the alloy without addition of magnesium, the eutectic growth morphology presents as cellular, with the cell spacing being about 1.7 mm. Unlike other single-phase alloys, however, the cellular eutectic grain boundary is not so straight and contrarily it has small branches that are considered to be related to the interaction with gas bubbles formed in the specimens. When 0.35% Mg is added into the alloy, columnar eutectic grains are formed, with obvious lateral branches although these are not well developed. The primary dendrite spacing of eutectic grains is about 1.8 mm. When addition of magnesium is up to 0.45%, the eutectic grains become equiaxed dendrites with an average grain size of 0.8 mm. Importantly, the microporosity level is significantly reduced except for the edge of the specimen. When the alloy contains 0.6% magnesium, a directional columnar grain structure can be observed. The solid specimen has an even lower level of porosity (microporosity) than with other shown alloys. Also, the eutectic structure consists of a large amount of small globular grains with various sizes, of an average size of 0.1 mm. These small equiaxed eutectic grains have no such branches; this indicates that a great number of heterogeneous sites for eutectic nucleation had operated. Thus it can be concluded that during solidification of this alloy (0.6% Mg), primary aluminum dendrites first grow protruding into liquid and then a great number of eutectic grains nucleate continuously to form fine equiaxed eutectic grains. In the specific embodiments where a 0.6% magnesium level was analyzed, the alloy also contained 0.04% Boron.

Comparison of the architecture of specific embodiments of the proposed alloy with a widely used cast alloy that is prior art also shows that the proposed alloy is less porous (even when the same casting conditions have been used). Such less porous alloys provide specific advantages, including increased strength.

Figure 2:
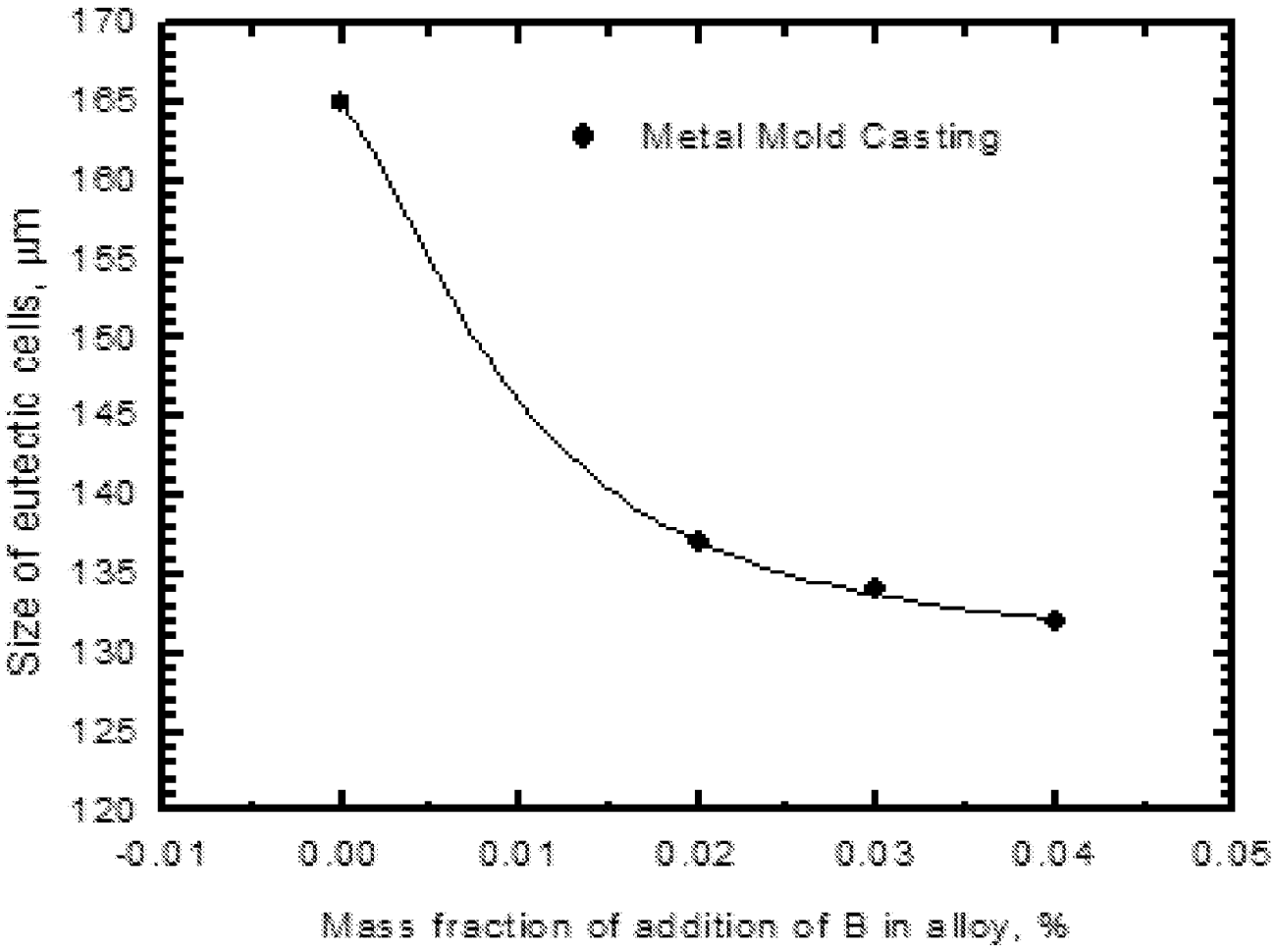
FIG. 2 shows a graph of the effect of the addition of Boron on the size of the eutectic grains in Al-12.3% Si, 0.41% Mg, 0.25% Cu, 0.15% Fe, 0.026% Sr by quantitative metallograph analysis.

Referring to FIG. 2, FIG. 2 shows a graph of the effect of the addition of Boron on the size of the eutectic grains in Al-12.3% Si-0.41% Mg-0.25% Cu-0.15% Fe-0.026% Sr alloy by quantitative metallograph analysis.

In specific embodiments described herein the copper content is kept in a range of up to approximately 0.5% Copper. This is advantageous as having a high copper content (such as 3-4 percent) can significantly affect the solidus and thus the alloy freezing range (liquidus-solidus). For two similar alloys, a first with 3-4% copper and a second having 0.5% copper, the solidus for the first alloy may be 500 C and for the second may be 545 C; the freezing range for the first alloy can be 70 C and for the second, 25 C. The second alloy offers advantages such as having a reduced tendency of the alloy to form shrinkage porosity.

According to another aspect of the various embodiments, an aluminum alloy is herein described consisting essentially of, by weight percentage, from about 11% to about 13.5% Silicon, up to about 0.5% Copper, from about 0.15 to about 0.55% Magnesium, up to about 0.4% Iron, up to about 0.4% Manganese, up to about 0.1% Titanium, up to about 0.5% Zinc, from about 0.015% to about 0.08% Strontium, from about 0.01% to about 0.05% Boron, and the balance aluminum.

According to specific embodiments, an aluminum alloy is herein described consisting essentially of, by weight percentage, from about 11% to about 13.5% Silicon, up to about 0.5% Copper, from about 0.35 to about 0.55% Magnesium, up to about 0.4% Iron, up to about 0.4% Manganese, up to about 0.1% Titanium, up to about 0.5% Zinc, from about 0.02% to about 0.08% Strontium, from about 0.04% to about 0.05% Boron, and the balance aluminum.

EXAMPLES

The described embodiments will be better understood by reference to the following examples, which are offered by way of illustration and which one skilled in the art will recognize are not meant to be limiting.

Example 1

A heat of an alloy of the embodiments nominally comprising, in weight percentage, 11.8% Si, 0.33% Mg, 0.2% Fe, 0.034% Sr, and 0.032% B, and balance Al and incidental impurities (Embodiment 1 of the invention) was made by the following steps. The proper amounts of Al-10% Si, Al-50% Si, Al-25% Fe, Al-25% Mn (weight %) master alloys and pure magnesium metal were carefully weighed and melted in a clay-graphite crucible in an electric resistance furnace. Once degassed and cleaned, the melt was treated with an agent to effect eutectic aluminum-silicon phase and/or intermetallic phase modification. A preferred agent to this end comprises Sr and B. The preferred method is to use Al-10% Sr and Al-3% B (weight %) master alloys, added into the melt during the last stages of degassing, provided no halogen material is used. Once processed, the alloy composition and gas content were checked and the alloy melt was gravity poured into metal molds to form at least five test bars having the dimensions of 12.7 mm in diameter in cross-section and about 200 mm long.

The cast test bars then were subjected to the T6 heat treatment (solution treated at 535±5 degrees C. for 8 hours, then hot water (50 degrees C.) quenched, and then aged at 155±5 degrees C. for 3 hours). Tensile testing was performed using ASTM procedures B557.

For comparison, a heat of conventional aluminum alloy A356 was made and cast in similar manner to provide test bars which were further heat treated to the T6 condition (solution treated at 535±5 degrees C. for 8 hours, then hot water (50 degrees C.) quenched, and then aged at 155±5 degrees C. for 3 hours). Tensile testing of the specimens was performed in similar manner.

Table 1 sets forth the results of the mechanical property testing where UTS is ultimate tensile strength (MPa) and percent Elongation is the plastic strain at fracture.

TABLE 1

| | | UTS | | % Elongation | |
|---|---|---|---|---|---|
| Alloy | | Average | Minimum | Average | Minimum |
| Embodiment 1 | As-cast | 270.5 | 262.4 | 9.8 | 7.6 |
| Embodiment 1 | T6 | 345.2 | 334.7 | 15.1 | 13.0 |
| A356 | T6 | 262 | 254 | 1.5 | 1.2 |

With respect to the alloy embodiment in example 1, it is apparent that the test specimens of the alloy exhibited a better combination of tensile strength and elongation compared to the test specimens of the conventional alloy A356. Moreover, importantly, the test specimens of the alloy exhibited very high elongation compared with the test specimens of alloy A356. As a result, alloys herein describe may enable the design of castings of lower weight since the castings will have improved mechanical properties and can be designed with reduced section thickness.

Example 2

A heat of an alloy of the embodiments nominally comprising, in weight %, 12.6% Si, 0.3% Mg, 0.18% Fe, 0.045% Sr, and 0.026% B, and balance Al and incidental impurities (Embodiment 2 of the invention) was made by the steps as described above for Example 1. The melt treatment, casting, heat treatment, and tensile testing of the test specimens is the same as described above for Example 1.

Table 2 sets forth the results of the mechanical property testing where UTS is ultimate tensile strength (MPa) and percent Elongation is the plastic strain at fracture.

TABLE 2

| | | UTS | | % Elongation | |
|---|---|---|---|---|---|
| Alloy | | Average | Minimum | Average | Minimum |
| Embodiment 2 | As-cast | 260.4 | 251.4 | 8.5 | 7.1 |
| Embodiment 2 | T6 | 330.8 | 321.9 | 14.2 | 12.8 |
| A356 | T6 | 262 | 254 | 1.5 | 1.2 |

With respect to alloys of described embodiments, it is again apparent that the test specimens of the alloy exhibited a better combination of tensile strength and elongation compared to the test specimens of the conventional alloy A356. Moreover, importantly, the test specimens of the alloy exhibited very high elongation compared with the test specimens of alloy A356.

Example 3

A heat of an alloy of the embodiments nominally comprising, in weight %, 13.25% Si, 0.25% Mg, 0.19% Fe, 0.048% Sr, and 0.022% B, and balance Al and incidental impurities (Embodiment 3 of the invention) was made by the steps as described above for Example 1. The melt treatment, casting, heat treatment, and tensile testing of the test specimens is the same as described above for Example 1.

Table 3 sets forth the results of the mechanical property testing where UTS is ultimate tensile strength (MPa) and percent Elongation is the plastic strain at fracture.

TABLE 3

| | | UTS | | % Elongation | |
|---|---|---|---|---|---|
| Alloy | | Average | Minimum | Average | Minimum |
| Embodiment 3 | As-cast | 254.7 | 247.2 | 8.0 | 6.9 |
| Embodiment 3 | T6 | 325.3 | 317.7 | 13.5 | 11.7 |
| A356 | T6 | 262 | 254 | 1.5 | 1.2 |

With respect to specific embodiments of alloys herein described, it is again apparent that the test specimens of specific alloys exhibited a better combination of tensile strength and elongation compared to the test specimens of the conventional alloy A356. Moreover, importantly, the test specimens of alloys herein described exhibited very high elongation compared with the test specimens of alloy A356.

Example 4

A heat of an alloy of the embodiments nominally comprising, in weight %, 12.3% Si, 0.41% Mg, 0.25% Cu, 0.15% Fe, 0.026% Sr, and 0.032% B, and balance Al and incidental impurities (Embodiment 4 of the invention) was made by the steps as described above for Example 1. The melt treatment, casting, heat treatment, and tensile testing of the test specimens is the same as described above for Example 1.

The described embodiments provide significant advantages as to ultimate tensile strength, yield strength, fatigue, and elongation properties as compared with current alloys. Characteristics of an alloy of specific embodiments described herein are compared in relation to one of the most common Al—Si based alloys used in making engine blocks and cylinder heads (A356, 7.0% Si, 0.58% Mg, 0.15% Cu, 0.13% Fe, 0.013% Sr, and 0.013% Ti, and balance Al). As can be seen from Tables 4 and 5, the embodiments herein described provide significant advantages as to tensile properties at room temperature and at high temperature. For completeness, as-cast and T6 versions are included in the comparison.

TABLE 4

Room Temperature Tensile Properties

| Alloy | | UTS, MPa Average | UTS, MPa Minimum | YS, MPa Average | YS, MPa Minimum | % Elongation Average | % Elongation Minimum |
|---|---|---|---|---|---|---|---|
| A356 | As-cast | 179.8 | 168.8 | 115.6 | 109.2 | 4.4 | 3.6 |
| | T6 | 266.9 | 252.4 | 210.4 | 204.6 | 6.7 | 4.9 |
| Embodiment 4 | As-cast | 198.4 | 189.3 | 108.1 | 102.5 | 6.5 | 5.4 |
| | T6 | 297.6 | 288.8 | 230.5 | 222.4 | 11.5 | 9.8 |

TABLE 5

High Temperature Tensile Properties

| Alloy | | 100° C. Average | 100° C. Minimum | 150° C. Average | 150° C. Minimum | 200° C. Average | 200° C. Minimum |
|---|---|---|---|---|---|---|---|
| A356T6 | UTS, MPa | 151.8 | 142.7 | 144.7 | 139.2 | 142.1 | 137.5 |
| | % Elongation | 3.9 | 3.3 | 3.3 | 3.1 | 2.4 | 2.2 |
| Embodiment 4 | UTS, MPa | 200.7 | 196.1 | 174.6 | 169.7 | 151.5 | 147.33 |
| | % Elongation | 9.5 | 8.7 | 9.3 | 8.5 | 8.4 | 7.9 |

Example 5

A heat of an alloy of the embodiments nominally comprising, in weight %, 12.2% Si, 0.51% Mg, 0.20% Cu, 0.18% Fe, 0.025% Sr, 0.03Ti, and 0.041% B, and balance Al and incidental impurities (Embodiment 5 of the invention) was made by the steps as described above for Example 1. The melt treatment, casting, heat treatment, and tensile testing of the test specimens is the same as described above for Example 1.

The described embodiments provide significant advantages as to ultimate tensile strength, yield strength, fatigue, and elongation properties as compared with current alloys. Characteristics of an alloy of specific embodiments described herein are compared in relation to one of the most common Al—Si based alloys used in making engine blocks and cylinder heads (A356: 7.0% Si, 0.58% Mg, 0.15% Cu, 0.13% Fe, 0.013% Sr, and 0.013% Ti, and balance Al). As can be seen from Tables 6, the embodiments herein described provide significant advantages as to tensile properties at room temperature and at high temperature. For completeness, as-cast and T6 versions are included in the comparison.

TABLE 6

Room Temperature Tensile Properties

| Alloy | | UTS, MPa Average | UTS, MPa Minimum | YS, MPa Average | YS, MPa Minimum | % Elongation Average | % Elongation Minimum |
|---|---|---|---|---|---|---|---|
| A356 | As-cast | 179.8 | 168.8 | 115.6 | 109.2 | 4.4 | 3.6 |
| | T6 | 266.9 | 252.4 | 210.4 | 204.6 | 6.7 | 4.9 |
| Embodiment 5 | As-cast | 192.3 | 187.2 | 106.5 | 103.2 | 5.6 | 5.1 |
| | T6 | 314.7 | 306.4 | 269.1 | 260.2 | 6.3 | 5.4 |

Example 6

For specific embodiments of alloy(s), a Ti containing grain refinement agent is not needed because the alloy(s) does not have primary aluminum grains to be refined. Ti-containing grain refiner is for refining primary aluminum dendrite grains. The primary aluminum grains appear as branching formations forming first in the liquid metal when it cools down below the liquidus (~615 C for A356 alloy which contains 6-7% Si). The primary aluminum dendrite grains can only be seen in a hypoeutectic alloy (the initial alloy composition has less than 11.8% Si). The eutectic grains form at eutectic temperature of about 570 C or below. The eutectic reaction (Liquid->Al+Si) happens after the primary aluminum dendrite grains form in the hypoeutectic alloy (the eutectic reaction is the phase transformation from liquid with alloy composition of Al-11.8% Si) in an Al—Si based alloy system to solid phases of Al and Si at the same time. In the eutectic reaction, the eutectic aluminum phase is not dendritic morphology. The eutectic aluminum phase, together with flake or fibrous silicon phase form globular eutectic grains). Also, the eutectic reaction (Liquid->Al+Si) happens when the remaining liquid composition becomes eutectic (Al-11.8% Si). Instead, B is needed to refine the eutectic grains in specific embodiments. Our alloy is a eutectic alloy with few primary aluminum dendrite grains. In specific embodiments a refinement result of eutectic grains has been achieved in our experiments with a combination of Mg (>0.35%), Sr (>0.02%), and B (>0.04%).

In melt treatment, the base alloy without Sr and B was first melt in a furnace at a temperature of 760 C. After holding for 30 minutes, Al-10 wt % Sr master alloy was added to the melts at about 720 C by controlling Sr content. After Sr was added, the melt was held for at least another 30 minutes prior to adding B grain refinement. Prior to pouring the liquid melt into casting, the Al-4% B master alloy was added to the melt at about 700 C by controlling the B content at about 0.04%.

It should be understood that the invention is not limited to the specific embodiments or constructions described above but that various changes may be made therein without departing from the spirit and scope of the invention as set forth in the appended claims.

What is claimed is:

1. An aluminum alloy consisting essentially of, by weight percentage, from about 11% to about 13.5% Silicon, up to about 0.2% Copper, from about 0.15% to about 0.55% Magnesium, from about 0.3% to about 0.4% Iron, about 0.4% Manganese, up to about 0.1% Titanium, about 0.5% Zinc, from about 0.015% to about 0.08% Strontium, from about 0.01% to about 0.05% Boron, and the balance aluminum.

2. The alloy of claim 1 wherein the ratio of Manganese to Iron is 0.6 to 1.0.

3. A cast cylinder head for an internal combustion engine formed of the alloy recited in claim 1.

4. At least one of an engine block, wheel, suspension part, or airplane door formed of the alloy recited in claim 1.

5. The aluminum alloy of claim 1 wherein the aluminum alloy consists essentially of, in weight percentage, from about 11.5% to about 13% Silicon, up to about 0.2% Copper, from about 0.3% to about 0.4% Magnesium, from about 0.3% to about 0.4% Iron, about 0.4% Manganese, up to about 0.1% Titanium, about 0.5% Zinc, from about 0.015% to about 0.08% Strontium, from about 0.01% to about 0.05% Boron, and the balance aluminum.

6. The aluminum alloy of claim 1 wherein the weight percentage of Silicon is from about 11.5% to about 12.5%, the weight percentage of Strontium is from about 0.03% to about 0.04%, and the weight percentage of Boron is from about 0.03% to about 0.04%.

7. The aluminum alloy of claim 1 wherein the weight percentage of Silicon is about 12.5%, the weight percentage of Strontium is from about 0.04% to about 0.05%, and the weight percentage of Boron is from about 0.025% to about 0.03%.

8. The aluminum alloy of claim 1 wherein the weight percentage of Silicon is 11.8%, the weight percentage of Magnesium is 0.33%, from about 0.3% to about 0.4% Iron, the weight percentage of Strontium is 0.034%, and the weight percentage of Boron is 0.032%.

9. The aluminum alloy of claim 1 wherein total impurity is less than 0.15% by weight.

10. The aluminum alloy of claim 1 wherein the weight percentage of Silicon is from about 13% to about 13.5%.

11. The aluminum alloy of claim 1 wherein the weight percentage of Strontium is from about 0.05% to about 0.08%.

12. An automotive cylinder head formed of the alloy consisting essentially of, by weight percentage, from about 11% to about 13.5% Silicon, up to about 0.2% Copper, from about 0.15% to about 0.55% Magnesium, from about 0.3% to about 0.4% Iron, about 0.4% Manganese, up to about 0.1% Titanium, about 0.5% Zinc, from about 0.015% to about 0.08% Strontium, from about 0.01% to about 0.05% Boron, and the balance aluminum.

13. The automotive cylinder head of claim 12 wherein the alloy is cast.

14. An aluminum alloy consisting essentially of, by weight percentage, from 11% to 13.5% Silicon, from 0.20% to 0.5% Copper, greater than 0.35% Magnesium, about 0.3% Iron, about 0.3% Manganese, up to 0.1% Titanium, from 0.1% to 0.4% Zinc, greater than 0.02% Strontium, greater than 0.032% Boron, and the balance aluminum.

15. The aluminum alloy according to claim 14, wherein the weight percentage Magnesium is from 0.4 to 0.55% Magnesium, the weight percentage of Strontium is from 0.02% to 0.08%, and the weight percentage of Boron is from 0.03% to 0.05% Boron.

16. A cast cylinder head for an internal combustion engine formed of the alloy recited in claim 14.

17. At least one of an engine block, wheel, suspension part, or airplane door formed of the alloy recited in claim 14.

18. The composition according to claim 14, wherein Titanium is not included.

19. The aluminum alloy of claim 14 wherein the weight percentage of Silicon is 12.6%, the weight percentage of Magnesium is 0.3%, from about 0.3% to about 0.4% Iron, the weight percentage of Strontium is 0.045%, and the weight percentage of Boron is 0.026%.

20. The aluminum alloy of claim 14 wherein the weight percentage of Silicon is 13.25%, the weight percentage of Magnesium is 0.25%, from about 0.3% to about 0.4% Iron, the weight percentage of Strontium is 0.048%, and the weight percentage of Boron is 0.022%.

* * * * *